US006406121B1

(12) United States Patent
Benjamin et al.

(10) Patent No.: US 6,406,121 B1
(45) Date of Patent: Jun. 18, 2002

(54) INKJET AIRBRUSH CONTROL SYSTEM

(75) Inventors: Trudy Benjamin, Portland, OR (US); Blair M. Kent, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/795,204

(22) Filed: Feb. 28, 2001

Related U.S. Application Data

(63) Continuation-in-part of application No. 09/773,391, filed on Jan. 31, 2001.

(51) Int. Cl.[7] ..... B41J 2/015; B41J 3/00
(52) U.S. Cl. ..... 347/20; 347/2
(58) Field of Search ..... 347/20, 2, 21, 347/25

(56) References Cited

U.S. PATENT DOCUMENTS

| | | | | |
|---|---|---|---|---|
| 1,709,926 A | | 4/1929 | Weaver | |
| 4,019,188 A | * | 4/1977 | Hochberg et al. | 346/75 |
| 4,508,271 A | | 4/1985 | Gress | |
| 4,546,922 A | | 10/1985 | Thometz | |
| 4,723,712 A | | 2/1988 | Egli et al. | |
| 5,086,978 A | | 2/1992 | Fertig | |
| 5,298,967 A | * | 3/1994 | Wells | 356/336 |
| 5,852,075 A | * | 12/1998 | Held | 523/161 |

OTHER PUBLICATIONS

Arthur H. Lefebvre, "Atomization and Sprays", 1989.

* cited by examiner

*Primary Examiner*—Thinh Nguyen

(57) ABSTRACT

A controller is provided for an inkjet airbrush system which uses inkjet printing technology for color mixing in airbrush painting, and for other fluid application systems. The controller is used to select a desired fluid blend or custom color which is blown by the inkjet airbrush onto an object. Firing signals, generated in response to the controller input, cause a printhead to eject a custom blend of colors which are combined in a mixing chamber and then atomized. The controller may be a remote device, or provided on-board the inkjet airbrush unit, preferably, as a joystick toggling device. The amount of colorant passing through the airbrush may be varied by varying the firing signal frequency in response to joystick motion or a separate adjustment mechanism. The inkjet airbrush system provides fast color changes and faster clean-up than conventional airbrushes. A method of controlling an inkjet airbrush is also provided.

60 Claims, 2 Drawing Sheets

INKJET AIRBRUSH CONTROL SYSTEM

RELATED APPLICATION

This is a continuation-in-part application of the co-pending U.S. patent application Ser. No. 09/773,391, filed on Jan. 31, 2001, both having at least one co-inventor in common.

INTRODUCTION

This description relates generally to inkjet printing technology which is used in a new nonconventional environment, here for color mixing in airbrush painting. Here we are dealing with a marriage of two, previously distinct technologies, which now yields several new patentable concepts. Before delving into a detailed description of these new concepts, a brief discussion of conventional inkjet technology may be helpful, along with some of the difficulties encountered with conventional airbrush technology.

Conventional inkjet printing mechanisms use cartridges, often called "pens," which shoot drops of liquid colorant, referred to generally herein as "ink," onto a page. Each cartridge has a printhead formed with very small nozzles through which the ink drops are fired. Most often, the printhead is held in a carriage that slides back and forth along a guide rod in a "reciprocating printhead" system, with the page being advanced in steps between each pass of the printhead. To print an image on paper media, for instance, the printhead is propelled back and forth across the page, shooting drops of ink in a desired pattern as it moves. Other printing systems, known as "page-wide array" printers, extend the printhead across the entire page in a stationary location and print as the media advances under the printhead. The particular ink ejection mechanism within either type of printhead may take on a variety of different forms known to those skilled in the art, such as those using piezo-electric or thermal printhead technology.

For instance, two earlier thermal ink ejection mechanisms are shown in U.S. Pat. Nos. 5,278,584 and 4,683,481, both assigned to the present assignee, the Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

Colors typically dispensed by the cartridges are black, cyan, yellow and magenta, with the resulting image color being obtained by mixing these four colors when the ink droplets impact the page. Recently, an imaging cartridge system has been introduced by the Hewlett-Packard Company of Palo Alto, Calif., as the DeskJet® 693C model inkjet printer. This is a two-pen printer which uses a tri-color cartridge, carrying full dye-loads of cyan, magenta and yellow, and a black cartridge which may be replaced with a tri-color imaging cartridge. This imaging cartridge carries reduced dye-load concentrations of some colors, such as cyan and magenta, along with a full or partial dye-load concentration of black ink. The imaging cartridge allows the printer to produce more continuous tone changes, particularly flesh tones, so the resulting image has near-photographic quality, with very little graininess. In the same vein, inkjet cartridges may be produced to carry custom colors, such as specialized tones having trademark notarization.

Turning now to airbrush technology, there are a variety of different styles and types of conventional airbrushes sold at most typical hobby stores. These handheld airbrushes are used for painting models, crafts, fingernails, pictures, automobiles, motorcycles, T-shirts, etc. A variety of different paint compositions may be used in these airbrushes, such as lacquers, inks, watercolors, thinned solvent-based enamels, airbrush acrylics, and the like. Typical airbrushes use compressed air to draw the fluid from a reservoir into a nozzle where the fluid is atomized and propelled onto a surface to create an image.

For projects requiring multiple colors, the conventional airbrush painter has several options as to how to proceed. One way to apply multiple colors is to prepare each color separately, spray it on the image, and then clean the airbrush before moving on to apply the next color. Unfortunately, the process of switching from one color to another is time consuming and messy, because the airbrush must be completely cleaned between colors. Indeed, mixing, trying and tuning in the colors is time consuming and costly in terms of wasted ink while trying to obtain the desired color mix. Another option for applying multiple colors is for the painter to use multiple airbrushes each carrying a single color. Unfortunately this option has its drawbacks, too, due to the added cost of purchasing multiple airbrushes, and because each of these airbrushes now must be cleaned at the completion of the paint job. A further drawback of these earlier systems is that the finished image is limited to having only the exact color and hue of the paint which is loaded in the airbrush.

One goal herein is to provide a new inkjet airbrush system and method which expands the concepts of inkjet printing to other uses, such as for painting artwork and other images on items like canvas, sculptures, murals, models, vehicles, etc.

DRAWING FIGURES

DETAILED DESCRIPTION

Figures 1, 2:
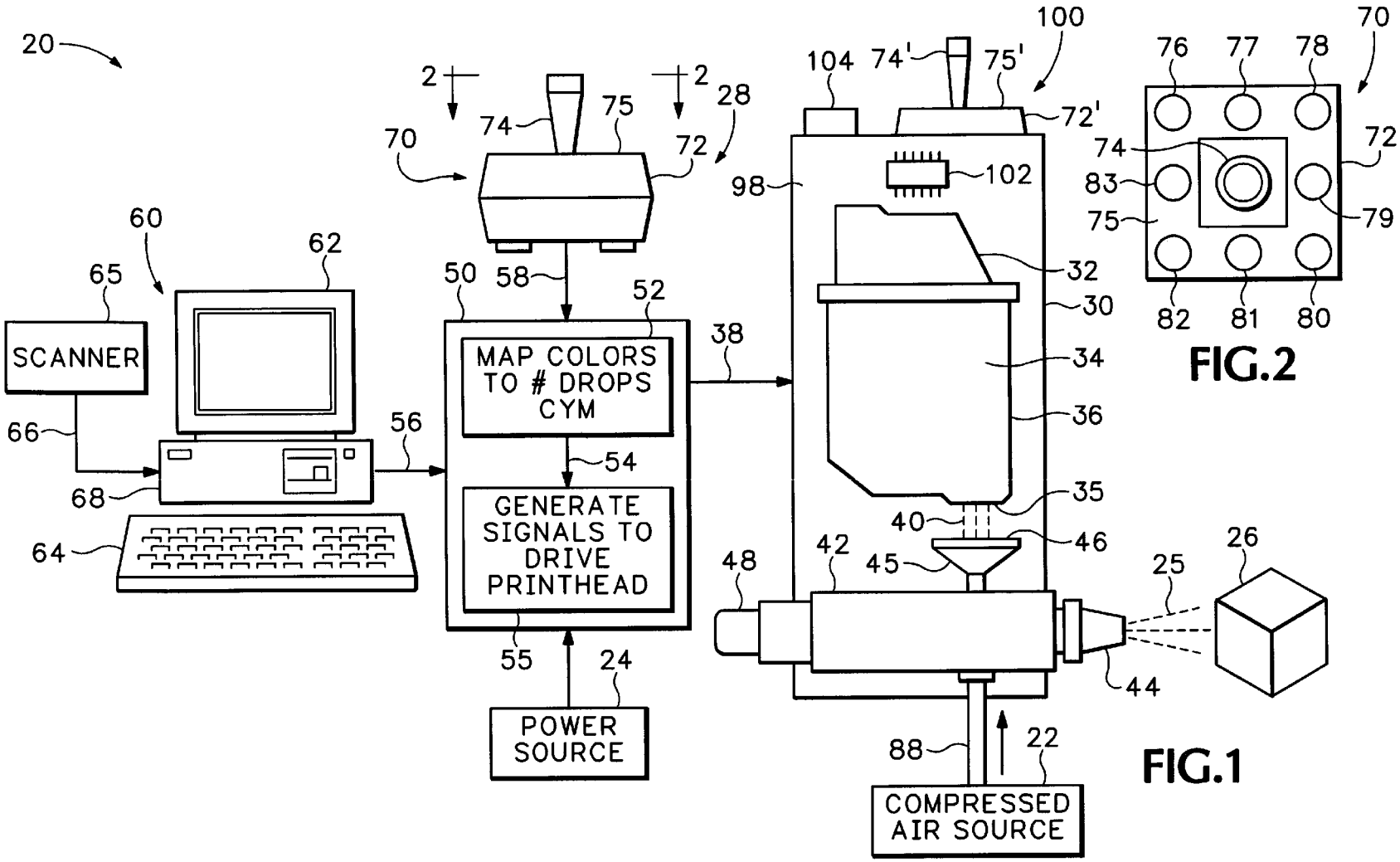
FIG. 1 is a partially schematic diagram of one form of an inkjet airbrush system using an internal atomizer, along with several different operator input systems.
FIG. 2 is a top plan view of one form of an operator input mechanism, taken along lines 2—2 of FIG. 1.

FIG. 1 illustrates one form of an inkjet airbrush system 20 constructed in accordance with the present invention. The system 20 receives an input of compressed air from a compressed air source 22, and electrical power from a power source 24, which are used to generate fluid droplets 25 to be sprayed onto an object, here shown as a cube or box 26. While compressed air is used for the illustrated embodiment, other similar propellants may be substituted for the air source 22. The system 20 includes an operator input and controller section 28, which receives inputs from an operator and generates control signals to power an inkjet airbrush portion 30 of the system. The inkjet airbrush 30 includes a fluid dispensing cartridge 32 which is based on inkjet technology to store one, but preferably two or more different types of fluid within a reservoir portion 34. The cartridge 32 also includes a printhead 35, which may be constructed using any type of known inkjet technology, such as thermal fluid ejection technology or piezo-electric fluid ejection technology. The cartridge 32 also includes a flex circuit 36, which is used as an electrical/mechanical interface to allow the cartridge 32 to receive firing signals 38 from the controller section 28. Upon receiving firing signals 38, the inkjet printhead 35 operates to dispense unmixed fluid 40 from the reservoir portion 34.

A variety of different inkjet cartridges may be substituted for the cartridge 32 illustrated in FIG. 1. The illustrated cartridge 32 represents the cartridge which was used in prototype testing, here the Hewlett-Packard Company's tri-color inkjet cartridge, part no. HP51525A, which has three reservoirs holding cyan, magenta, and yellow inkjet inks. The unmixed fluid 40 in FIG. 1 may be one, two or all three of these colors, depending upon the firing signals 38 which are received. The same technology used in the inkjet arts to deliver firing signals 38 and ink to printhead 35 may be used, including those used in reciprocating printhead printing systems, whether known as "on-axis" systems which carry all of their ink supply back and forth along the scanning axis, or those using "off-axis" technology where the main ink reservoir is stored at a remote location and ink is delivered to the reciprocating printheads via tubing or other fluidic conduits. Indeed, even page wide array printhead technology may be used, where a sheet of paper passes under a single stationary printhead which extends across the entire printzone. Thus, a variety of different inkjet printing technologies may be used to supply the unmixed fluid 40 in response to receiving firing signals 38, with the exact method used depending upon the particular implementation employed.

The inkjet airbrush 30 also includes an atomizer member 42, which has a nozzle portion 44 that ejects the fluidic droplets 25. The inkjet airbrush 30 also has a mixing member, such as mixing cup 45 which is used to couple the cartridge 32 with the atomizer 42. The illustrated mixing cup 45 has an interior surface which defines a mixing chamber 46 therein, to receive the unmixed fluid 40 ejected from printhead 35. Mixing may also occur as the ink 40 travels toward the mixing cup, as well as through the atomizer 42 and perhaps, even as droplets emerge from the nozzle and impinge on object 26. The illustrated atomizer 42 is an internal atomizer, which includes a fluid control section 48 that meters the amount of fluid delivered from the mixing cup 45 to the nozzle 44. Before discussing operation of the atomizer 42, along with several alternative embodiments for the atomizer 42, a description of the operator input and control section 28 will be given first. In the illustrated embodiment of FIG. 1, the atomizer nozzle 44 shown is representative of the prototype atomizer studied, which uses an Aztek nozzle manufactured by the Testor Corporation, of Rockford, Ill., although a nozzle with a shorter flow path is preferred for faster color changes. During prototype testing, the compressed air source 22 generated air pressures on the order of 10–20 psi (pounds per square inch), with good results being obtained using about 0.75 cc/min (cubic centimeters per minute) of ink flux. It is apparent that other air pressures and flow rates may be more suitable for other atomizer configurations and implementations.

The inkjet airbrush system 20 includes a droplet generation controller 50, which forms a portion of the controller section 28. The generation controller 50 has a mapping section 52 that supplies a droplet signal 54 to a firing signal generation section 55, which generates the firing signals 38 in response to input signals, such as signals 56 and 58 which are supplied to the controller 50. The mapping section 52 receives input signals 56, 58 requesting a desired color, and the mapping section 52 determines how many droplets of cyan (C), yellow (Y), and/or magenta (M) are required to generate the desired color, such as according to technology used in the inkjet arts to print images on media, e.g. paper. This information is carried via the drop signal 54 to the firing signal generator 55. The signal generator 55 may be a sophisticated device, choosing between which nozzles of the inkjet printhead 35 to fire based on various parameters known in the inkjet art, such as by alternating nozzles to provide more uniform heat dissipation throughout the printhead in thermal inkjet technologies. With the mixing cup 45 located directly under the printhead 35, it no longer becomes important which droplet from a given nozzle is fired, an important factor in printing technologies where selection of which nozzle to fire determines where the drop lands on the resulting image. For example, in the illustrated embodiment, the nozzles of the printhead 35 may be fired at frequencies of 0–3000 Hz (Hertz), although it is apparent that higher firing frequencies may be used depending upon the operating parameters of the particular inkjet cartridge and printhead employed. The intensity of the ink applied to the object 26 may be varied by varying the number of nozzles fired in an array or by varying the firing frequency of all nozzles to dispense different amounts of ink for mixing in cup 45.

Alternatively, the amount of ink applied to object 26 may be varied by varying the volume of the ink droplets 40 ejected from the printhead 35. For instance, when using a piezo-electric printhead, the drop volume may be controlled by changing the shape of the firing pulse applied to the piezo-electric member(s) associated with each nozzle. One way of varying the drop volume in a thermal inkjet printhead is to construct each firing chamber with more than one firing resistor, and then allow the controller 55, 102 to select how many resistors to energize for ink ejection from a nozzle, with more resistors being energized to eject droplets with larger volumes. Other means known to those skilled in the art may also be employed to vary the volume of ink droplets 40. Adjusting the drop volume allows the system 20 to vary the amount of ink applied to the object 26 "on the fly," without requiring the process of ink ejection, mixing, and atomization to be interrupted.

One illustrated operator input in the controller section 28 is a computer input section, such as a personal computer 60 which may be used to select the desired color inputs delivered via signal 56 to the droplet generation controller 50. A variety of different means may be used to generate the input signal 56. For instance, the computer 60 may include a touch screen monitor 62 which may be used to display a color pallet, such as a continuous tone color display, a color selection grid or a composition listing, with an operator touching the screen 62 at the location of the desired color to generate the input signal 56. Alternatively, the computer 60 may have a keyboard 64, a mouse or a touch pad input device (not shown) to select a color displayed upon monitor 62. Other inputs may be supplied to the computer 60, such as by using a scanner 65 which generates an input signal 66 representative of a pre-existing image placed in the scanner 65. Upon receiving the input signal 66 from the scanner 65, the computer 60 may be used to alter or edit the scanned image, prior to generating the input signal 56. It is apparent that other equivalent input mechanisms may be used to supply image data to the computer 60, for instance, by using a modem or web-based interface to download images from the worldwide web or internet, as well as reading images from conventional storage media, such as floppy diskettes or CD ROM disks. Indeed, if the motion of the inkjet airbrush nozzle 44 is known, if the movement of object 26 is known, or if the relative movement between the nozzle 44 and 26 is known and controllable, for instance using robotic technology, then the computer 60 may send swaths of color data to the droplet generation controller 50 to create the desired image on object 26.

In addition to, or instead of the computer 60, the inkjet airbrush system 20 may include a manual color input selection device 70, here illustrated as a "joystick" input device having a base 72 and a toggling input handle 74. The illustrated manual input device 70 includes a faceplate 75 which surrounds the handle 74. Other manual input devices may be more suitable for some implementations, such as roller ball devices, touch sensitive pads or screens, remote control devices, computer mouse devices, hand-held computer devices, and the like. As mentioned above, the joystick handle 74 may toggle in any direction, from 0–360° in the two dimensional planar view of FIG. 2. Thus, the joystick 72 may be considered to act as a two-dimensional manual input device. If the joystick device 72 were sensitive to an additional direction or type of motion from a neutral position, such as by elevating/depressing or clockwise/counterclockwise twisting of the handle, then the amount of travel from the neutral position may be used to control the intensity (amount of ink per unit time) of the ink applied to object 26, with greater amounts of travel corresponding to larger amounts of ink being supplied to the mixing chamber 46. Such an embodiment having intensity control in addition to color control may then be considered to be a three-dimensional manual input device. Other modifications may be made to the joystick device 70, as well as to the other manual input devices listed above, to convert them from two-dimensional devices to three-dimensional devices, for instance by adding a sliding or rotating switch which may be adjusted to vary the color intensity independent from the process of making color selections. Indeed, in some implementations it may be desirable to have the intensity control mounted closer to the nozzle 44 to allow an operator to make intensity adjustments while applying the ink 25 to object 26.

The illustrated faceplate 75 includes a plurality of color indicia surrounding handle 74, here illustrated as color spots 76, 77, 78, 79, 80, 81, 82 and 83. In the illustrated prototype embodiment, the colors assigned to each of the indicia 76–83 were selected as shown in Table 1 below.

TABLE 1

Joystick Face Plate Color Selection Palette
(100% is for all nozzles of a given color fired at 3000 Hertz)

| Item Numbers or Color Input Information | Selected Color Shown Indicia | Percentage Cyan Ink | Percentage Magenta Ink | Percentage Yellow Ink |
|---|---|---|---|---|
| 76 | Blue Green | 100. | 0. | 26.6667 |
| 77 | Yellow Green | 26.6667 | 0. | 100. |
| 78 | Yellow | 0. | 0. | 100. |
| 79 | Yellow Orange | 0. | 100. | 100. |
| 80 | Magenta | 0. | 100. | 0. |
| 81 | Red Violet | 26.6667 | 100. | 0. |
| 82 | Blue Violet | 100. | 26.6667 | 0. |
| 83 | Blue | 100. | 0. | 0. |
| Neutral/Center | Black | 100. | 100. | 100. |

While a series of color spots 76–83 are illustrated in FIG. 2, it is apparent that in some embodiments it may be desirable to have a continuous, rainbow-like color pattern surrounding the joystick handle 74, with the various colors gently blending into one another. Indeed, this rainbow selection was the effect achieved using the joystick 74 when selecting between two color spots, such as between adjacent spots 81 and 82, or between opposing spots 81 and 77. The type of joystick device 70 used may vary, with a simple analog potentiometer type of unit being used during prototype testing, allowing a rainbow of colors to be mixed using the inkjet airbrush 30. The intensity of each color applied to object 26 may be varied by the spacing between the nozzle 44 and the object 26, with closer spacings applying more ink per unit area to the object for a darker image, and larger spacings yielding lighter colors with less saturation of ink. Using some of the newer digital joysticks or similar input devices as selection device 70, not only the color mixture, but also the intensity may be easily and separately controlled, allowing for a full, three-plane or three-dimensional color signal 58 to be supplied to the droplet generation controller 50.

Furthermore, after achieving the desired color, the intensity may be separately varied by adjusting the volume of the ink droplets 40 as described above, or by adjusting the firing frequency of the printhead nozzles, assuming the spacing between the spray nozzle 44 and the object 26 remains relatively constant. By controlling the droplet volume or the firing frequency, the color intensity per unit area on object 26 may be more precisely electronically controlled, an option unavailable with conventional airbrushes. Thus, by supplying three color plane data to the droplet generation controller 50, a constant spacing may be maintained between the inkjet airbrush nozzle 44 and the object 26 receiving the droplets 25, with more droplets being delivered for increased intensity of color, and fewer droplets being supplied for lighter shades. For those unfamiliar with inkjet printing technology, it should be noted that while the cartridge 32 may also contain a fourth chamber for dispensing black ink, this is not a requirement because the combination of roughly equal amounts of cyan, yellow and magenta ink together combine to form a black color, known in the art as "process black," as opposed to a "true black" which would be dispensed from a separate reservoir containing only black ink. Thus, use of the tri-color (cyan, yellow, magenta) cartridge allows application of all colors on the object 26, including black. As shown in Table 1 above, this process black is obtained by leaving the joystick handle in a central, neutral position where the printhead is ejecting full amounts of cyan, yellow and magenta.

Moreover, it is apparent that the resulting colors mixed in chamber 46 may be mapped according to other color axis planes. For instance, one color space may be constructed using various combinations of (1) hue, (2) saturation, and (3) luminosity, in various combinations with the cyan, yellow and magenta inks. For instance, the three dimensional space described above was constructed using hue (the color mix of Table 1) and intensity. If only "black and white" type images are desired, a grayscale palette may be substituted for the color palette of cyan, yellow and magenta. These various multiple color axis spaces are familiar to those using various color artistry computer programs, such as PhotoShop® and Corel®. Furthermore, another color plane may be constructed using absolute amounts for each color, for instance by supplying separate controls to individually vary the intensity of each of the primary cyan, yellow and magenta inks ejected by printhead 35.

Figure 3:
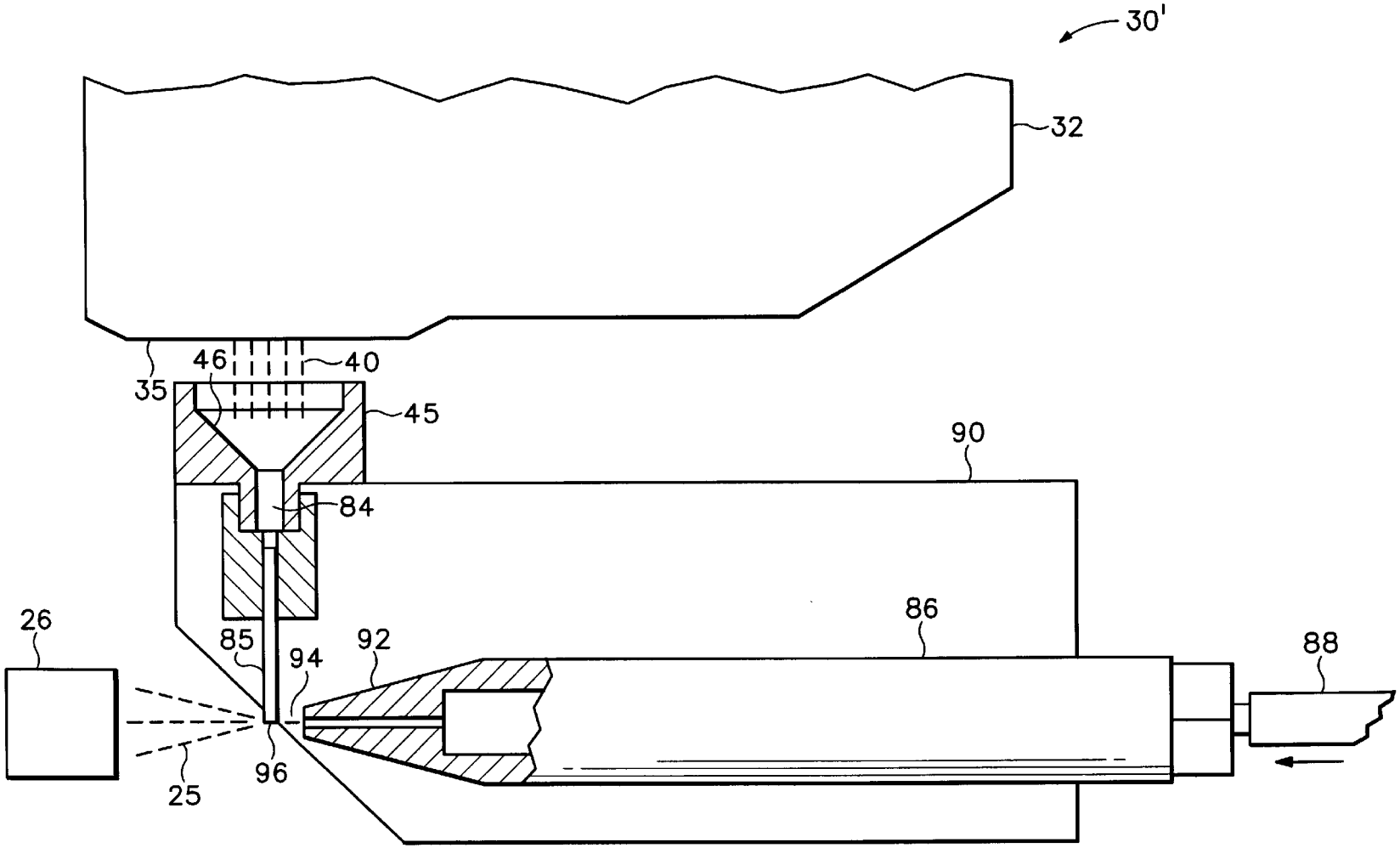
FIG. 3 is an enlarged, partially fragmented, front elevational view of an alternate inkjet airbrush system having an external atomizer, which may be used in the system of FIG. 1.

Turning now to FIG. 3, instead of using the internal atomizer 42 shown in FIG. 1, an alternate inkjet airbrush 30' may be formed using the fluid dispensing cartridge 32 and the mixing cup 45 as described above. The mixing chamber 46 is receives unmixed ink 40 dispensed by printhead 35. The mixing chamber 46 has a conically shaped cup surface, formed as a funnel with an outlet 84 to which is coupled a fluid transport tube 85. Compressed air may be delivered by the compressed air source 22, as described above, via an airflow tubing or conduit 86 and 88 to drive an external atomizer 90. The compressed air from source 22 is supplied to an atomizing nozzle 92, which together with the fluid conduit 86 forms the external atomizer 90. The external atomizer nozzle 92 is positioned to blast pressurized air 94 past an outlet 96 of the fluid conduit 85. As the air blast 94 flows past the conduit outlet 96, through a venturi effect this rushing air draws ink out of the mixing cup 45, and in this process causes the liquid ink to be atomized forming droplets 25 to paint object 26. Actually, the force of the pressurized air 94 passing by the conduit exit 96 reduces the pressure in this region, creating a vacuum force. This vacuum force created by the air 94 blowing from nozzle 92 serves to pull the ink from cup 45, with the exposure of the fluid to this vast moving air stream causing the fluid to atomize to create droplets 25.

Thus, in a broad sense the concepts disclosed herein deal with the precise metering and measuring of a single liquid, or the precise metering, measuring and mixing of two or more liquids to form a desired precise liquid compound using inkjet technology. Indeed, the inkjet cartridge 32 may be used for the precise metering of a single fluid. For instance, using the internal atomizer 42, flow through nozzle 44 of the fluid is generally controlled using the fluid flow control 48, which operates to move an internal needle either into or out of the path of ink flow to restrict or enhance the flow. The flow control provided by the needle adjust 48 may be eliminated in the inkjet airbrush context, where the amount of fluid flowing through nozzle 44 may be controlled by metering and measuring the amount of unmixed fluid 40 entering cup 45. Thus, a precise electronic metering of fluid by the printhead 35 replaces the crude mechanical fluid flow controls of earlier conventional airbrushes.

Another drawback of conventional airbrushes was the extensive clean-up time required. Using the inkjet airbrush system 20, clean-up is much easier because the ink is self-contained within the fluid dispensing cartridge 32. Moreover, by using one of the reservoir chambers 34 as an ink solvent reservoir, the airbrush 30 may be actually self-cleaning by ejecting the solvent from printhead 35 to clean the mixing cup 45 the internal portions of atomizer 42, and nozzle 44. For the external atomizer 90 of FIG. 3, such an ink solvent or other fluid solvent dispensed by the printhead 35 may be used to clean the inside of mixing cup 45, the exit port 84 and conduit 85, along with the exit opening 96. Indeed, one clean-up improvement was realized by minimizing the volume or space between printhead 35 and the atomizer nozzle 44, 96 which is installed within a body 98, illustrated schematically in FIG. 1.

The exact form of the body 98 depends upon ease of use and ergonomic considerations, along with the type of cartridge 32 and the type of atomizer 42, 90 which are used. Functionally, the body 98 provides an electrical connection via flex circuit 36 to receive firing signals generated by the operator input and controller section 28 of the system 20. Additionally, the body 98 serves to locate the printhead orifice plate 35 over an ink mixing region, such as mixing cup 45, in the broadest sense to precisely meter one or more fluids dispensed by cartridge 32. In a more detailed example in the context of an airbrush, the body 98 also serves to couple this mixing region or chamber provided by cup 45 with a fluid dispenser, here being the atomizers 42 and 90.

Regarding color choice, the color of fluid droplets 25 dispensed by the airbrush 30, 30' is determined by the ratios of the ink ejected as unmixed fluid 40. Indeed, while the illustrated airbrush system 20 shows a separate manual color input selection device 70, illustrated as a joystick device, in some embodiments it may be desirable to incorporate the color selection feature on the body 98, here shown as an integrated color input selection device 100, which may operate in the same fashion as described above for device 70. In such an implementation, using the onboard color selection device 100, the droplet generation controller 50 may be incorporated into the inkjet airbrush 30, and also supported by body 98, for instance, by supplying controller 50 as an integrated circuit, or more preferably as an application specific integrated circuit (ASIC) 102 or a field programmable gate array.

Indeed, by mounting the selection device 100 and controller 102 on or within the body 98, and by incorporating the power source 24, for instance in the form of batteries, within the body 98 a small hand-held unit or airbrush head may be formed, only requiring the attachment of a compressed air source 22. As a further enhancement, the compressed air source 22 may also be carried by the body 98, for instance in the form of a small compressed air cartridge, similar to those used in BB guns and pellet rifles. Thus, with both the power source 24 and the compressed air source 22 onboard the body 98, along with controller 102 and color selection toggle device 100, a completely portable airbrush unit is formed.

Such a portable airbrush unit may include an input device, shown schematically as input device 104, which may be coupled to a separate hand-held or other computing device. For instance, it may be particularly useful to have the input device 104 be digital input coupled to a device displaying a color selection chart, such as a Pantone book, calorimeter, or other color standard, where color selection may be made from a selection grid on the hand-held device, or digitally input in numeric or alpha numeric form. Alternatively, rather than having input 104 be a digital input, the input 104 may also be an analog input, for instance using one or more rotary knobs to select the amount of desired fluids to be dispensed by printhead 35. In an alternate embodiment, the input device 104 may be a numeric rotary wheel input, allowing a person to dial in a numeric or alpha numeric code corresponding to a selected color on a standard color chart, palette, or other predetermined list. Such a device would be particularly useful in a variety of different situations, for instance, to perform automotive touch up painting, where the color code for a vehicle is often printed on various name cards or placards affixed to the vehicle by the manufacturer. When a digital input device 104 is coupled to a computer or other hand-held computing device, the exact manner of coupling the two may be accomplished in a variety of ways known to those skilled in the art, for instance, using an electrical cable, fiber optics, infrared technology, radio waves, microwaves, etc.

Regarding the color mixing surface of the mixing cup 45, as the inks or other unmixed fluid 40 are ejected from printhead 35 they strike a mixing surface, the function of which is to quickly draw the inks through the funnel like structure of the mixing cup and to the airbrush for dispersion before the ink or other fluid dries. Thus, it may be undesirable for the inks or fluid to build up excessively on the mixing surface before entering the feed port of the internal atomizer 42, or conduit 85 of the external atomizer 90. For example, if one color entered the airbrush supply port at the bottom of the funnel-like mixing cup 45, while another color builds up in an adjacent portion of the mixing surface then the color output of the airbrush would vary. A mixing surface, such as one constructed of a stainless steel or a plastic, which both worked well, allowed the inks to passively mix. During prototype testing, the inner surface of the mixing cup was varied in texture, to determine whether placing grooves in the cup 45 would enhance ink mixing and flow through the mixing cup. However, prototype testing indicated no significant advantage to a textured surface over a smooth mixing surface for the dye-based inks tested; however, in other implementations using other fluids, a grooved or textured interior surface may prove more satisfactory than a smooth surface.

A more specific use for this precision metering of a liquid, and more particularly for the mixture of two or more liquids, is illustrated in terms of an inkjet airbrush system 20. Two examples of airbrush technology have been given, the internal atomizer 42 of FIG. 1, and the external atomizer 90 of FIG. 3. Further study by the inventor has revealed a variety of equivalent atomizers which may be substituted for atomizers 42 and 90 in creating the inkjet airbrushes, such as 30 and 30' according to the concepts described herein.

There are a variety of general methods of atomization which may be substituted for atomizers 42 and 90, and incorporated into an inkjet airbrush system. One of the first general methods of atomization is known as a twin-fluid atomizer. The internal and external airbrushes 42, 90 fall within this twin-fluid atomizer category, with one fluid here being the inkjet ink, and the other the air from the compressed air source 22. Another type of atomizer which may be suitable in some inkjet airbrush implementations is a rotary atomizer which atomizes without requiring an external air pump. Rather than a precise beam of fluid droplets 25, rotary atomizers typically provide a spray pattern extending in 360°, which would be useful to paint the interior of pipes, storage tanks, and the like for instance. Another type of suitable atomizer is a pressure atomizer, which operates in a fashion similar to automotive fuel injectors and airless paint systems. With a pressurized atomizer, the fluid is under a high enough pressure, and the nozzle exit diameter is small enough, that the ejected fluid atomizes as it comes into contact with the air. Two other general methods of atomization include ultrasonic atomization, which typically is used in medical applications, and electrostatic atomization, typically used in paint sprayers. Several of these atomization mechanisms and spray methods are discussed in Arthur H. Lefebvre's book entitled "Atomization and Sprays," published in 1989 by Hemisphere Publishing Corporation, USA. A variety of different atomizers equivalent to atomizers 42 and 90 are described in Mr. Lefebvre's book, although it is apparent that other atomizers or other devices for generating a spray of fluid droplets 25 from liquid fluid 40 may also be substituted for atomizers 42 and 90.

The color output of the airbrush 30, 30' may be determined by the amount of ink fired into the mixing chamber 45 from each of the color reservoirs within cartridge 32. Preferably the compressed air source 22 is activated when the ink is firing into the mixing chamber 45 to draw the mixed ink out the chamber and into the airbrush nozzle 44 or opening 96 where the fluid is atomized and then ejected as droplets 25. If the air source 22 is not activated during the ejection of the unmixed fluid 40, then the ink may possibly overfill the mixing cup 45, dirtying the interior of the airbrush body 98. To prevent this situation, the controller 50, 102 may coordinate operation of the air source 22 with the firing signal 38, to assure this spillage situation is avoided. However, the spillage problem may occur any time when the ink 40 flowing into the mixing chamber 46 is greater than the amount of ink drawn out and expelled through nozzle 44 or opening 96. Thus, balancing ink flow, air flow and nozzle geometry together provides an adequate solution to this spillage problem. For instance, in the prototype testing the geometry of nozzle 44 and the air flow through conduit 88 were adjusted to prevent the ink from overflowing the mixing chamber 45.

The inkjet airbrush system 20, whether using a separate operator input and controller section 28, or onboard inputs 100, 104 allows the user of airbrush 30, 30' to quickly choose and produce a desired color output 25. Furthermore, the smaller the volume of space through which the ink travels from the printhead 35 to the exit of the spray nozzle 44 the faster color changes will be accomplished. The range of colors to choose from will be based on the contents of the fluid reservoirs 34 inside the cartridge 32. Furthermore, there is a significant time savings in being able to dial in the desired color, whether using manual input devices 64, 70, 100, 104 or the scanner 65 and computer 60, rather than requiring colors to be manually mixed as in the past with conventional airbrushes. Color mapping from the ink supplies within cartridge 32 to the airbrush output 44, 96 also allows for color selection from the computer screen 62. Once the colors are selected, the mapping section 52 determines what ratios of the base colors are required to produce the desired color. In this manner, digital, precise metering is achieved using the inkjet cartridge 32, leading to color reproduction which is enhanced over other earlier airbrushing techniques.

As mentioned above, a separate or non-artistic use for the airbrush system 20 may be to precisely meter two or more fluids for mixing, or to meter a single fluid. In the illustrated embodiments, inkjet inks have been used merely for convenience, and it is apparent that other fluids may also be mixed and ejected using the airbrush systems 30, 30'. For instance, various epoxy-type compounds having a fluid and a reagent that when mixed together form a time-sensitive mixture before becoming hardened may be suitably dispensed using the airbrush 30, 30'. In such a system, upon mixing the fluid and reagent hardening begins to occur immediately so there is a greater need to quickly apply fluid droplets 25 following ejection of the unmixed fluid 40 into cup 45. In some adhesive or bonding implementations, it may be desirable to include a third action, such as an ultra-violet curing step, to delay the mixture from hardening while traveling through the atomizer 42, 90.

Of course as a further modification, the inkjet airbrush 100 may be further modified to be an airbrush color mixer, for instance, by having the mixing cup 45 feed into a conventional airbrush paint reservoir. Such an implementation may be particularly useful where only small amounts of colorant are needed, such as when painting or applying polish to fingernails. Alternatively, the airbrush 42 may be designed with a small ink reservoir which is detachable from the mixing cup 30 for greater ease of handling with a more compact, lighter applicator. As a further alternative, the mixing cup 45 may stay attached to the atomizer 42 during use, with the cartridge 32 being detachable from the mixing cup 45.

Additionally, use of the precise color mixing provided by the inkjet airbrush system 20 advantageously allows two different inkjet airbrushes to accurately provide the same color output, for instance when two people are working on a project using two separate inkjet airbrushes. Moreover, use of a small mixing surface within cup 45 quickly brings different inks together and promotes passive mixing as the inks fall under the force of gravity down the conical walls of cup 45. Furthermore, in the mixing cup 45, liquid surface tension pulls the inks together and toward the exit port at the base of the mixing cup. Indeed, the liquid surface tension of the fluids in the mixing cup 45 in combination with the suction force provided by the atomizer 42 may actually overcome the force of gravity, allowing a user to paint an overhead object without any spillage. In this manner, minimal ink is wasted, and only the ink which is required to be placed on object 26 is mixed and used, thus providing consumers with a longer lasting cartridge 32. Furthermore, since the inkjet airbrush 30, 30' does not meter or control ink flow using a mechanical device, such as needle valves, mechanical levers, motors and the like, the inkjet airbrush 30, 30' is much less complex than earlier airbrush systems. Furthermore, as mentioned above since both textured and smooth surfaces for the mixing cup 45 were tested with no apparent difference in performance, a smooth surface is preferred because it is easier to clean than a textured surface. Finally, since fewer components of the inkjet airbrushes 30 and 90 are actually wet by the fluids being dispensed from printhead 35, the amount of clean-up required is minimized.

Thus, it is apparent that a variety of different modifications may be made to the fluid application system, and its use may be for applications other than inkjet ink mixing or painting, while still falling within the scope of the claims below. For instance, the claims as originally presented below speak of a printhead which selectively ejects one or more plural fluids in response to a firing signal, statements which clearly encompass a printhead fluidically coupled to one or more reservoirs containing fluid(s) of the same composition. Indeed, in some implementations it may be desirable to have a printhead coupled to a single reservoir dispensing a single fluid. In other implementations it may be desirable to have the printhead coupled to two or more reservoirs each containing a fluid of the same composition, for instance so the reservoirs are depleted in a cascading order, allowing an operator to receive an alarm when the last reservoir is being tapped which allows the operator to assure that replacement ink, or whatever fluid composition is being dispensed, is on hand before the currently installed cartridge empties.

We claim:

1. A method of controlling an airbrush mechanism having a fluid-ejecting printhead and an atomizer which atomizes fluid therefrom, with the printhead selectively ejecting one or more plural fluids in response to a firing signal, comprising:

receiving an input for a composition corresponding to at least one of said plural fluids;

in response thereto, generating said firing signal to eject said composition from the printhead;

supplying said composition to the atomizer; and atomizing said composition.

2. A method according to claim 1 further comprising, before said generating, mapping a number of fluid droplets for each of said plural fluids corresponding to said composition.

3. A method according to claim 1 wherein one of said plural fluids comprises a first fluid, and another of said plural fluids comprises a second fluid which, when mixed together with the first fluid, forms a time-sensitive mixture.

4. A method according to claim 1 wherein said plural fluids comprise different colorants and said composition comprises a selected color.

5. A method according to claim 1 further comprising generating said input in response to a manual input.

6. A method according to claim 5 wherein said generating the manual input comprises selecting said composition from a palette of plural compositions.

7. A method according to claim 6 wherein said selecting comprises displaying the palette on a computer device.

8. A method according to claim 7 further comprising communicating the selected composition from the computer device to the printhead.

9. A method according to claim 8 wherein said communicating further comprises communicating a selected intensity for said selected composition from the computer device to the printhead.

10. A method according to claim 6 wherein:

said plural fluids comprise different colorants and said composition comprises a selected color; and said generating the manual input comprises selecting said selected color from a palette comprising a color selection palette.

11. A method according to claim 10 wherein said selecting comprises displaying the color selection palette on a computer device.

12. A method according to claim 11 further comprising communicating the selected color from the computer device to the printhead.

13. A method according to claim 12 wherein said communicating further comprises communicating a selected intensity for said selected color from the computer device to the printhead.

14. A method according to claim 10 wherein:

each color of said color selection palette has a specific color information associated therewith; and said generating of the manual input comprises providing specific color information associated with said selected color to the printhead.

15. A method according to claim 14 wherein said providing of the specific color information to the printhead comprises manually inputting said information to a manual input device which is in communication with the printhead.

16. A method according to claim 15 wherein said manually inputting further comprises manually inputting a selected intensity for said selected color to the printhead.

17. A method according to claim 15 wherein said manual input device comprises a joystick device having a toggling switch surrounded by a faceplate having color indicia thereon corresponding to colors of said color selection palette, wherein said manually inputting comprises moving said toggling switch toward at least one of said color indicia.

18. A method according to claim 16 further comprising providing the joystick device, the printhead and the atomizer as a unit supported by a single body.

19. A method according to claim 16 wherein indicia indicative of a combination of a first colorant and a second colorant appears on the faceplate between indicia indicative of said first colorant and indicia indicative of said second colorant.

20. A method according to claim 16 further comprising varying an intensity of said composition by using said joystick device.

21. A method according to claim 6 further comprising manually inputting said selected composition to a manual input device which is in communication with the printhead.

22. A method according to claim 21 wherein said manual input device comprises a joystick device having toggling switch surrounded by a faceplate displaying indicia thereon corresponding to said plural compositions of said palette, and wherein said manually inputting comprises moving said toggling switch toward at least one of said indicia.

23. A method according to claim 22 further comprising providing the joystick device, the printhead and the atomizer as a unit supported by a single body.

24. A method according to claim 22 further comprising varying an intensity of said composition by using said joystick device.

25. A method according to claim 24 wherein said providing comprises providing the joystick device with an intensity adjustment, and said varying the intensity comprises adjusting the intensity adjustment.

26. A method according to claim 1 further including generating an input comprising a two-axis selection for the composition mixture and a third-axis selection which varies another factor of the composition to produce a three dimensional composition selection system.

27. A method according to claim 1 wherein said composition has a property defined by a first selection from a first group of choices and a second selection from a second group of properties, and said generating comprises generating said input in response to said first selection and said second selection.

28. A method according to claim 27 wherein said generating comprises generating said input in response to a manual input representative of said first selection and said second selection.

29. A method according to claim 28 wherein said generating comprises generating said input using a manual input device comprising a two-dimensional input device responsive to said manual input.

30. A method according to claim 29 wherein:

said plural fluids comprise different colorants and said composition comprises a selected color; and said first and second group of properties together define said selected color.

31. A method according to claim 30 wherein said manual input device comprises a joystick device having a toggling switch surrounded by a faceplate with color indicia thereon at least one of which corresponds to said selected color, wherein said manually inputting comprises moving said toggling switch toward said at least one color indicia corresponding to said selected color.

32. A method according to claim 29 further comprising controlling an amount per unit time of said composition supplied to the atomizer.

33. A method according to claim 32 wherein said controlling comprises controlling said amount per unit time in response to a third selection from a third group of properties, and said generating comprises generating said input in response to said third selection.

34. A method according to claim 33 wherein said generating comprises generating said input in response to a manual input representative of said third selection.

35. A method according to claim 34 wherein said generating comprises generating said input using a manual input device comprising a three-dimensional input device responsive to said manual input.

36. A method according to claim 1 further comprising controlling an amount per unit time of said composition supplied to the atomizer.

37. A method according to claim 36 wherein said controlling comprises adjusting a firing frequency of said firing signal.

38. A method according to claim 36 wherein:

said fluid is ejected from said printhead in a droplet; and said controlling comprises adjusting a volume of said droplet.

39. A method according to claim 1 wherein said plural fluids each have the same composition.

40. A controller for controlling an airbrush mechanism having a fluid-ejecting printhead and an atomizer which atomizes fluid therefrom, with the printhead selectively ejecting one or more plural fluids in response to an input signal, comprising a joystick device having toggling switch surrounded by a faceplate having indicia thereon, wherein moving said toggling switch toward at least one of said indicia generates the input signal.

41. A controller according to claim 40 further including a body which supports the joystick device, the printhead and the atomizer.

42. A controller according to claim 40 further including a conductor which delivers the input signal from the joystick device to the printhead.

43. A controller according claim 40 wherein said plural fluids comprise different colorants, and the faceplate has indicia indicative of each of said different colorants and combinations of said colorants.

44. A controller according to claim 43 wherein indicia indicative of a combination of a first colorant and a second colorant appears on the faceplate between indicia indicative of said first colorant and indicia indicative of said second colorant.

45. A controller according to claim 40 further comprising an intensity adjustment which varies a number of fluid droplets ejected by the printhead by varying a frequency of said input signal.

46. A controller according to claim 40 further comprising an intensity adjustment which varies a volume of the fluid droplets ejected by the printhead.

47. A controller according to claim 40 wherein said plural fluids each have the same composition.

48. A controller for controlling an airbrush mechanism having a fluid-ejecting printhead and an atomizer which atomizes fluid therefrom, with the printhead selectively ejecting one or more plural fluids in response to an input signal, comprising a manual input device which generates the input signal in response to selection of a composition corresponding to at least one of said plural fluids.

49. A controller according to claim 48 wherein said composition has a property defined by a first selection from a first group of choices and a second selection from a second group of properties, and wherein the manual input device generates the input signal in response to a selection of said first selection and said second selection.

50. A controller according to claim 49 wherein said manual input device comprises a two-dimensional input device.

51. A controller according to claim 50 wherein:

said plural fluids comprise different colorants and said composition comprises a selected color; and said first and second group of properties together define said selected color.

52. A controller according to claim 51 wherein said manual input device comprises a joystick device having a toggling switch surrounded by a faceplate with color indicia thereon at least one of which corresponds to said selected color, wherein said input signal is generated in response to moving said toggling switch toward said at least one color indicia corresponding to said selected color.

53. A controller according to claim 50 wherein said one or more plural fluids are ejected from the printhead in an amount per unit time of said composition in response to the input signal, wherein said amount per unit time is controlled in response to a third selection from a third group of properties, and wherein the manual input device generates the input signal in response to a selection of said third selection.

54. A controller according to claim 53 wherein said manual input device comprising a three-dimensional input device.

55. A controller according to claim 48 wherein said one or more plural fluids are ejected from the printhead in an amount per unit time of said composition in response to the input signal, and wherein the manual input device generates the input signal in response to a selection of said amount per unit time.

56. A controller according to claim 55 wherein said input signal adjusts a firing frequency of said firing signal.

57. A controller according to claim 55 wherein:

said fluid is ejected from said printhead in a droplet; and said input signal adjusts a volume of said droplet.

58. A controller according to claim 48 further including a body which supports the manual input device, the printhead and the atomizer.

59. A controller according to claim 48 wherein the manual input device comprises a two-axis selection for the composition mixture and a third-axis selection which varies another factor of the composition to produce a three dimensional manual input device.

60. A controller according to claim 48 wherein said plural fluids each have the same composition.

* * * * *